US005292630A

United States Patent [19]

Shimada et al.

[11] Patent Number: 5,292,630

[45] Date of Patent: Mar. 8, 1994

[54] SILVER HALIDE COLOR PHOTOGRAPHIC MATERIAL CONTAINING AN IMIDAZOTRIAZOLE CYAN COUPLER

[75] Inventors: Yasuhiro Shimada; Kozo Sato, both of Kanagawa, Japan

[73] Assignee: Fuji Photo Film Co., Ltd., Kanagawa, Japan

[21] Appl. No.: 18,454

[22] Filed: Feb. 16, 1993

[30] Foreign Application Priority Data

Feb. 17, 1992 [JP] Japan ..... 4-61474

[51] Int. Cl.[5] ..... G03C 7/38

[52] U.S. Cl. ..... 430/548; 430/558; 430/384; 430/385

[58] Field of Search ..... 430/558, 384, 385, 548

[56] References Cited

U.S. PATENT DOCUMENTS 4,910,127 3/1990 Sakaki et al. ..... 430/558

FOREIGN PATENT DOCUMENTS 2278552 12/1987 Japan ..... 430/558

OTHER PUBLICATIONS

*Research Disclosure*, No. 162216, Oct. 1977, pp. 73–75.

*Primary Examiner*—Lee C. Wright

*Attorney, Agent, or Firm*—Sughrue, Mion, Zinn, Macpeak & Seas

[57] ABSTRACT

A silver halide color photographic material containing one or more imidazotriazole cyan couplers each having an electron attracting group with a $\sigma p$ of 0.35 or more in at least one layer on the support. The material provides a cyan color image having a sharp light absorption characteristic absorbing light having a relatively long wavelength falling within a narrow wavelength range. The imidazotriazole cyan coupler is of the following structural formula (I):

(I)

where $R_1$ represents a hydrogen atom or a substituent; $R_2$ represents an electron attracting group having a Hammett's constant value $\sigma p$ of 0.35 or ore; X represents a hydrogen atom or a group released by coupling with an oxidation product of an aromatic primary amine color developing agent; and $R_1$ or $R_2$ may also be a divalent group forming a dimer or higher polymer, or they each may be bonded to a polymer chain to form a homopolymer or copolymer.

10 Claims, No Drawings

SILVER HALIDE COLOR PHOTOGRAPHIC MATERIAL CONTAINING AN IMIDAZOTRIAZOLE CYAN COUPLER

FIELD OF THE INVENTION

The present invention relates to a silver halide color photographic material (hereinafter simply referred to as a photographic material).

BACKGROUND OF THE INVENTION

Formation of indophenol, indaniline, indamine, azomethine, phenoxazine, phenazine and like dyes by reaction of the oxidation product of an aromatic primary amine color developing agent formed by oxidation with an oxidizing agent of exposed silver halide and a coupler to provide color dyes is well known in color photography. In a photographic system of this kind, the subtractive color process is employed in which color images are formed from yellow, magenta and cyan dyes.

Of them, phenol or naphthol couplers are generally used for forming cyan color images. However, since the couplers have an unfavorable absorption in the green color range, severe problems in terms of a noticeable reduction in color reproducibility occur. Therefore, the solution of the problem is desired.

Recently, various cyan couplers of heterocyclic compounds have been proposed, in addition to phenol and naphthol couplers. Above all, imidazotriazole couplers as described in *Research Disclosure,* No. 16216 (1977) are typical examples.

190

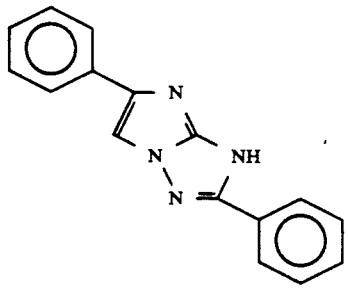

191

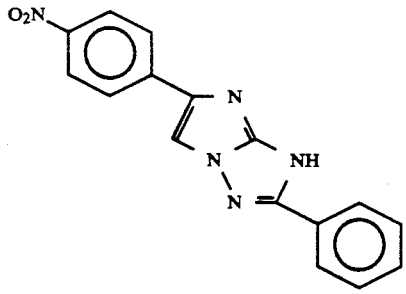

However, the dyes formed from the couplers described therein have a wavelength range of from 576 to 612 nm, and the wavelength is short. Further, these dyes have a broad half-value width.

SUMMARY OF THE INVENTION

Therefore, a first object of the present invention is to provide a silver halide color photographic material containing a novel cyan coupler capable of providing a dye which shows a λmax value of from 620 to 700 nm and provides a sharp absorption wavelength range form.

A second object of the present invention is to provide a silver halide color photographic material forming a color image which is fast to heat and moisture, with excellent color reproducibility.

The objects of the present invention are attained by a silver halide color photographic material comprising a support having thereon a layer containing at least one imidazotriazole cyan coupler of the following formula (I).

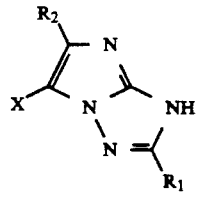

(I)

where $R_1$ represents a hydrogen atom or a substituent; $R_2$ represents an electron attracting group having a Hammett's constant value $\sigma p$ of 0.35 or more; X represents a hydrogen atom or a group released on a coupling reaction with an oxidation product of an aromatic primary amine color developing agent; and $R_1$ or $R_2$ may be a divalent group forming a dimer or higher polymer, or they each may be bonded to a polymer chain to form a homopolymer or copolymer thereof.

DETAILED DESCRIPTION OF THE INVENTION

Couplers of formula (I) for use in the present invention are described in detail hereunder.

Since imidazotriazole cyan couplers of formula (I) for use in the present invention have a strong electron attracting group at the position adjacent the coupling active position in the imidazole ring, they provide dyes having a long wavelength range and having a sharp wavelength range.

In formula (I), $R_2$ represents an electron attracting group having a Hammett's substituent constant $\sigma p$ value of 0.35 or more. The upper limit of the $\sigma p$ value of the group is 1.0 or less. Hammett's rule is an empirical rule proposed by L. P. Hammett in 1935 for the purpose of quantitatively discussing the influence of substituents on reactions or equilibria of a benzene derivative having the substituent thereon. This rule has become widely accepted. The substituent constant to be obtained by the Hammett's rule includes a $\sigma p$ value and a $\sigma m$ value, and these are referred to in the literature. For instance, Hansh, G. Leo et al, J. Med. Chem., 16, 1207 (1973); ibid., 20, 304 (1977); J. A. Dean, *Lange's Handbook of Chemistry,* 12th Ed. (1979), (Mc Graw-Hill); and *Range of Chemistry,* Special Edition, No. 122, pp. 96–103 (1979), (Nankoh Do Publishing) describe these constants in detail. $R_2$ in formula (I) in the present invention is defined by its Hammett's substituent constant $\sigma p$ value, which, however, does not mean that $R_2$ is limited to only those as referred to in the publications along with their $\sigma p$ values. Needless to say, $R_2$ therefore indicates any and substituent, including undescribed or unknown substituent, which may have a $\sigma p$ value falling within range set forth above as determined by the Hammett's rule.

Where the substituents as referred to herein have an aliphatic moiety, the term "aliphatic" means a linear, branched or cyclic aliphatic hydrocarbon residue, including alkyl, alkenyl, alkynyl and the like saturated and unsaturated groups which may optionally be substituted by other substituents. Specific examples of such are, in a monovalent form, a methyl group, an ethyl group, an n-butyl group, a dodecyl group, an octadecyl group, an eicosenyl group, an iso-propyl group, a tert-butyl group, a tert-octyl group, a tert-dodecyl group, a cyclohexyl group, a cyclopentyl group, an allyl group, a vinyl group, a 2-hexadecenyl group and a propargyl group. Preferred is an alkyl group.

Where substituents as referred to herein have an aromatic moiety, the term "aromatic" means an aryl group which may optionally be substituted by other substituents. Specific examples of such a group are a phenyl group, a naphthyl group and a 2,4-dimethanesulfonylphenyl group.

Where the substituents as referred to herein have a heterocyclic moiety, the term "heterocyclic" means a ring containing at least one of nitrogen, sulfur and oxygen atoms, as a hetero atom including saturated and unsaturated rings which may optionally be substituted by other substituents. Specific examples of such are an imidazolyl group, a pyridyl group, a furyl group, a thienyl group, a thiazolyl group, a triazolyl group, a tetrazolyl group, and a 1-phenyl-2-benzimidazolyl group.

Specific preferred examples of electron attracting groups having a $\sigma p$ value of 0.35 or more are a cyano group ($\sigma p$ value, 0.66), a nitro group (0.78), a carboxyl group (0.45), a fluorine-substituted alkyl group (preferably having from 1 to 20 carbon atoms, such as trifluoromethyl (0.54), perfluorobutyl), an aliphatic, aromatic or heterocyclic acyl group (preferably having from 2 to 50 carbon atoms, such as acetyl (0.50), benzoyl (0.43)), a formyl group (0.42), an aliphatic, aromatic or heterocyclic sulfonyl group (preferably having from 1 to 50 carbon atoms, such as trifluoromethanesulfonyl (0.92), methanesulfonyl (0.72), benzenesulfonyl (0.70)), an aliphatic, aromatic or heterocyclic sulfinyl group (preferably having from 1 to 50 carbon atoms, such as methanesulfinyl (0.49)), a carbamoyl group (preferably having from 1 to 50 carbon atoms, such as carbamoyl (0.36), methylcarbamoyl (0.36), phenylcarbamoyl, 2-chlorophenylcarbamoyl), an aliphatic, aromatic or heterocyclic oxy-carbonyl group (preferably having from 2 to 50 carbon atoms, such as methoxycarbonyl (0.45), ethoxycarbonyl, diphenylmethylcarbonyl, phenoxycarbonyl (0.44)), a heterocyclic group (preferably having from 1 to 50 carbon atoms, such as pyrazolyl (0.37), 1-tetrazolyl (0.50)), an azo group (preferably having from 1 to 50 carbon atoms, such as phenylazo (0.39)), an alkylsulfonyloxy group (preferably having from 1 to 50 carbon atoms, such as methanesulfonyloxy (0.36)), a phosphoryl group (preferably having from 2 to 50 carbon atoms, such as dimethoxyphosphoryl (0.60), diphenylphosphoryl), a sulfamoyl group (preferably having from 0 to 50 carbon atoms, such as sulfamoyl (0.57)), a pentachlorophenyl group, a pentafluorophenyl group (0.41), and a sulfonyl-substituted aromatic group (preferably having from 6 to 56 carbon atoms, such as 2,4-dimethanesulfonylphenyl). Preferably, $R_2$ is a cyano group, an aliphatic or aromatic oxycarbonyl group, an aliphatic or aromatic sulfonyl group, an aliphatic or aromatic acyl group, a carbamoyl group, a pentafluorophenyl group, a pentachlorophenyl group, a perfluoroalkyl group, or a sulfamoyl group. More preferably, $R_2$ is a cyano group, an alkoxycarbonyl group, or an aryloxycarbonyl group. Most preferably, $R_2$ is a cyano group.

In formula (I), $R_1$ represents a hydrogen atom or a substituent. Suitable examples of $R_1$ are a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic-oxy group, an azo group, an acyloxy group, a carbamoyloxy group, a silyloxy group, an aryloxycarbonylamino group, an imido group, a heterocyclic-thio group, a sulfinyl group, a phosphonyl group, an aryloxycarbonyl group, an acyl group, and an azolyl group. These groups of $R_1$ may further be substituted, for example, by those mentioned for the preceding group $R_2$.

More precisely, $R_1$ is a hydrogen atom, a halogen atom (e.g., chlorine, bromine), an aliphatic group (preferably having from 1 to 36 carbon atoms, such as methyl, ethyl, propyl, isobutyl, t-butyl, tridecyl, 2-methanesulfonylethyl, 3-(3-pentadecylphenoxy)propyl, 3-{4-{2-[4-(4-hydroxyphenylsulfonyl)phenoxy]-dodecanamido}-phenyl}propyl, 2-ethoxytridecyl, trifluoromethyl, cyclopentyl, 3-(2,4-di-t-amylphenoxy)-propyl), an aromatic group (preferably having from 6 to 36 carbon atoms, such as phenyl, naphthyl, 4-t-butylphenyl, 2,4-di-t-amylphenyl, 4-tetradecanamidophenyl), a heterocyclic group (preferably having from 1 to 36 carbon atoms, such as 3-pyridyl, 2-furyl, furyl, 2-thienyl, 2-pyridyl, 2-benzothiazolyl, 2-pyrimidinyl), an alkoxy group (preferably having from 1 to 36 carbon atoms, such as methoxy, ethoxy, 2-methoxyethoxy, 2-dodecyloxyethoxy, 2-methanesulfonylethoxy), an aryloxy group (preferably having from 6 to 36 carbon atoms, such as phenoxy, 2-methylphenoxy, 4-t-butylphenoxy, 3-nitrophenoxy, 3-t-butyloxycarbamoylphenoxy, 3-methoxycarbamoylphenoxy), an aliphatic, aromatic or heterocyclic acyloxy group (preferably having from 2 to 36 carbon atoms, such as acetoxy, hexadecanoyloxy), a carbamoyloxy group (preferably having from 2 to 36 carbon atoms, such as N-ethylcarbamoyloxy), an aliphatic, aromatic or heterocyclic sulfonyloxy group (preferably having from 1 to 36 carbon atoms, such as dodecylsulfonyloxy), an aliphatic, aromatic or heterocyclic acylamino group (preferably having from 2 to 36 carbon atoms, such as acetamido, benzamido, tetradecanamido, $\alpha$-(2,4-tert amylphenoxyacetamido, $\alpha$-[4-(4-hydroxyphenylsulfonyl)phenoxy]-decanamido, isopentadecanamido), an anilino group (preferably having from 6 to 36 carbon atoms, such as phenylamino, 2-chloroanilino, 2-chloro-5-tetradecanamidoanilino, N-acetylanilino, 2-chloro-5-[$\alpha$-2-tert-butyl-(4-hydroxyphenoxy)dodecanamido]anilino), a ureido group (preferably having from 2 to 36 carbon atoms, such as phenylureido, dimethylureido), a sulfamoylamino group (preferably having from 1 to 36 carbon atoms, such as N,N-dipropylsulfamoylamino, N-methyl-N-decylsulfamoylamino), an alkenyloxy group (preferably having from 2 to 36 carbon atoms, such as 2-propenyloxy), an alkylamino group (preferably having from 1 to 36 carbon atoms (e.g., butylamino, dimethylamino), an aliphatic, aromatic or heterocyclic acyl group (preferably having from 2 to 36 carbon atoms, such as acetyl, benzoyl, 2,4-di-tert-amylphenoxy-acetyl), an aliphatic, aromatic or heterocyclic sulfonyl group (preferably having from 1 to 36 carbon atoms, such as methanesulfonyl, benzenesulfonyl, trifluoromethanesulfonyl, toluenesulfonyl), an aliphatic, aromatic or heterocyclic oxycarbonyl group (preferably having from 2 to 36 carbon atoms, such as methoxycarbonyl, butoxycarbonyl, dodecyloxycarbonyl, octadecyloxycarbonyl, phenyloxycarbonyl, 2-pentadecyloxycarbonyl), an aliphatic, aromatic or heterocyclic oxycarbonylamino group (preferably having from 2 to 36 carbon atoms, such as methoxycarbonylamino, tetradecyloxycarbonylamino, phenoxycarbonylamino, 2,4-di-tert-butylphenoxycarbonylamino), an aliphatic, aromatic or heterocyclic sulfonamido group (preferably having from 1 to 36 carbon atoms, such as methanesulfonamido, hexadecanesulfonamido, benzenesulfonamido, p-toluenesulfonamido, octadecane-sulfonamido, 2-methylxoy-5-tert-butylbenzenesulfonamido), a carbamoyl group (preferably having from 1 to 36 carbon atoms, such as N-ethylcarbamoyl, N,N-dibutylcarbamoyl, N-(2-dodecyloxyethyl)carbamoyl, N-methyl-N-dodecylcarbamoyl, N-[3-(2,4-di-tert-amylphenoxy)propyl]carbamoyl), a sulfamoyl group (preferably having from 1 to 36 carbon atoms, such as N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a phosphoryl group (preferably having from 2 to 36 carbon atoms, such as dimethoxyphosphoryl, diphenylphosphoryl), a sulfamido group (preferably having from 2 to 36 carbon atoms, such as dipropylsulfamido), an imido group (preferably having from 1 to 36 carbon atoms, such as succinimido, hydantoinyl), a hydroxyl group, a cyano group, a carboxyl group, a nitro group and a sulfo group.

Preferably, $R_1$ is an alkyl group, an aryl group, an alkoxy group, an aryloxy group, an acylamino group, a sulfonamido group, an alkylamino group, an anilino group, a ureido group, a sulfamoylamino group, an alkoxycarbonylamino group, an aryloxycarbonylamino group, a carbamoyl group, a sulfamoyl group, a sulfonyl group, an alkoxycarbonyl group, an aryloxycarbonyl group, an acyloxy group, or a carbamoyloxy group. More preferably, $R_1$ is an alkyl group, an aryl group, an acylamino group, a sulfonamido group, a ureido group, a sulfamoylamino group, a carbamoyl group, or a sulfamoyl group. Particular preferably, $R_1$ is an alkyl group, an aryl group or a ureido group.

In formula (I), X is a hydrogen atom or a group capable of being released on reaction with an oxidation product of an aromatic primary amine color developing agent (hereinafter simply referred to as "a release group"). Where X is a release group, examples include, for example, a halogen atom; an aromatic azo group; an aliphatic group, an aromatic group or a heterocyclic group bonding to the coupling position of the formula (I) via an oxygen, nitrogen, sulfur or carbon atom; a group bonding to an aliphatic, aromatic or heterocyclic sulfonyl group, or to an aliphatic, aromatic or heterocyclic sulfinyl group, or to an aromatic, aliphatic or heterocyclic carbonyl group; and a heterocyclic group bonding to the coupling position via the nitrogen atom of the heterocyclic ring. The aliphatic, aromatic or heterocyclic group in the release group may optionally be substituted by substituent(s) such as those described for the group $R_1$ and a halogen atom. Where it is substituted by two or more substituents, the substituents may be same or different. The substituent may further be substituted by substituent(s) such as those described for the group $R_1$ and a halogen atom.

Specific examples of suitable release atoms or groups, are a halogen atom (e.g., fluorine, chlorine, bromine), an alkoxy group (preferably having from 1 to 36 carbon atoms, such as ethoxy, dodecyloxy, methoxyethylcarbamoylmethoxy, carboxypropyloxy, methanesulfonylethoxy), an aryloxy group (preferably having from 6 to 36 carbon atoms, such as 4-chlorophenoxy, 4-methoxyphenoxy, 4-carboxyphenoxy), an aliphatic, aromatic or heterocyclic acyloxy group (preferably having from 2 to 36 carbon atoms, such as acetoxy, tetradecanoyloxy, benzoyloxy), an aliphatic or aromatic sulfonyloxy group (preferably having from 1 to 36 carbon atoms, such as methanesulfonyloxy, toluenesulfonyloxy), an aliphatic, aromatic or heterocyclic acylamino group (preferably having from 1 to 36 carbon atoms, such as dichloroacetylamino, heptafluorobutyrylamino), an aliphatic or aromatic sulfonamido group (preferably having from 1 to 36 carbon atoms, such as methanesulfonamido, p-toluenesulfonamido), an alkoxycarbonyloxy group (preferably having from 2 to 36 carbon atoms, such as ethoxycarbonyloxy, benzyloxycarbonyloxy), an aryloxycarbonyloxy group (preferably having from 7 to 36 carbon atoms, such as phenoxycarbonyloxy), an aliphatic, aromatic or heterocyclic thio group (preferably having from 1 to 36 carbon atoms, such as ethylthio, 2-carboxyethylthio, phenylthio, tetrazolylthio), a carbamoylamino group (preferably having from 2 to 36 carbon atoms, such as N-methylcarbamoylamino, N-phenylcarbamoylamino), a 5-membered or 6-membered nitrogen-containing heterocyclic group (preferably having from 1 to 36 carbon atoms, such as imidazolyl, pyrazolyl, triazolyl, tetrazolyl, 1,2-dihydro-2-oxo-1-pyridyl), an imido group (preferably having from 1 to 36 carbon atoms, such as succinimido, hydantoinyl), and an aromatic azo group (preferably having from 6 to 36 carbon atoms, such as phenylazo). Further, examples of a release group bonded to the formula via a carbon atom, are residues of bis-type couplers obtained by condensation of 4-equivalent couplers with aldehydes or ketones. The release group of the invention may contain a photographically useful group, e.g., a development inhibitor, a development accelerator and other groups. Preferably, X is a hydrogen atom, a halogen atom or an aromatic thio group. More preferably, X is a hydrogen atom or a chlorine atom.

The coupler of formula (I) may be in the form of a dimer or a higher polymer, in which $R_1$ or $R_2$ is a divalent group; or it may also be in the form of a homopolymer or copolymer in which $R_1$ or $R_2$ is bonded to a high polymer chain. Typical examples of homopolymer or copolymer where $R_1$ or $R_2$ is bonded to a polymer chain, include a homopolymer or copolymer of an addition-polymerizing ethylenic unsaturated compound having a residue of the coupler of formula (I). The homopolymer or copolymer of this kind may contain one or more color forming repeat units containing a residue of the coupler of formula (I). The copolymer may contain one or more non-coloring ethylenic monomers as the comonomer component. The color forming repeat unit containing a residue of the coupler of formula (I) is preferably represented by the following general formula (P):

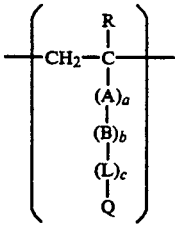

(P)

where R represents a hydrogen atom, an alkyl group having from 1 to 4 carbon atom, or a chlorine atom; A represents —CONH—, —COO—, or a substituted or unsubstituted phenylene group; B represents a substituted or unsubstituted alkylene, phenylene or aralkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$—or —$SO_2NH$—; a, b and c each represent 0 or 1; and Q represents a coupler residue derived from a compound of formula (I) by removing a hydrogen atom of $R_1$ or $R_2$ therefrom. The alkylene, phenylene or aralkylene group represented by A or B may optionally be substituted by substituent(s) such as those described for the group $R_1$ of formula (I).

A preferred polymer or copolymer is a copolymer composed of a color monomer represented by the coupler unit of formula (I) and a non-coloring ethylenic monomer not coupling with an oxidation product of an aromatic primary amine developing agent.

Examples of non-coloring ethylenic monomer not coupling with an oxidation product of an aromatic primary amine developing agent to form the copolymer are, for example, acrylic acid, α-chloroacrylic acid, α-alkylacrylic acids (e.g., methacrylic acid), amides or esters to be derived from these acrylic acids (e.g., acrylamide, methacrylamide, n-butylacrylamide, t-butylacrylamide, diacetylacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxy methacrylate), vinyl esters (e.g., vinyl acetate, vinyl propionate, vinyl laurate), acrylonitrile, methacrylonitrile, aromatic vinyl compounds. (e.g., styrene and its derivatives, such as vinyltoluene, divinylbenzene, vinylacetophenone, sulfostyrene), itaconic acid, citraconic acid, crotonic acid, vinylidene chloride, vinyl alkyl ethers (e.g., vinyl ethyl ether), maleates, N-vinyl-2-pyrrolidone, N-vinylpyridine, and 2- and 4-vinylpyridines.

Of these units, especially preferred are acrylates, methacrylates and maleates. Two or more such non-coloring ethylenic monomers may be used together to form the polymer. For instance, the combination of methyl acrylate and butyl acrylate; the combination of butyl acrylate and styrene; the combination of butyl methacrylate and methacrylic acid; and the combination of methyl acrylate and diacetone acrylamide are suitable.

As is well known in the field of polymer couplers, ethylenic unsaturated comonomers copolymerized with vinyl monomers corresponding to the above-mentioned formula (I) are so selected that the physical and/or chemical properties of the copolymers formed therefrom, such as their solubility, their compatibility with binders of photographic compositions such as gelatin, their flexibility as well as their thermal stability are advantageously influenced by the selected comonomers.

Couplers of the formula (I) used in the present invention react with an oxidation product of a primary amine developing agent to give cyan dyes having an absorption peak falling within the range of from 620 to 700 nm.

Specific examples of couplers of the formula (I) used in the present invention are mentioned below. However, the scope of the present invention is not to be construed as being limited to these compounds.

| No. | $R_1$ | $R_2$ | X |
|---|---|---|---|
| 1 | 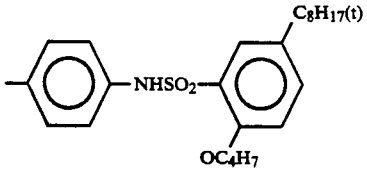 | CN | H |
| 2 | 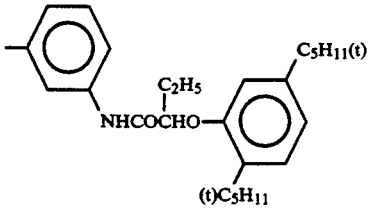 | CN | H |
| 3 | 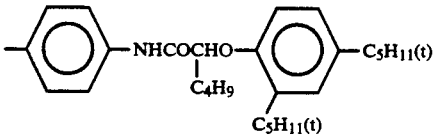 | $-CO_2CH_2CH_3$ | H |

-continued
| No. | $R_1$ | $R_2$ | X |
|---|---|---|---|
| 4 | 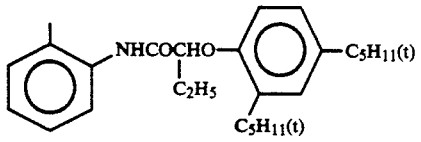 | $CF_3$ | H |
| 5 | 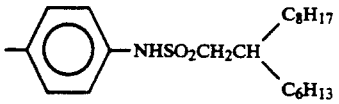 | 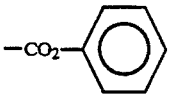 | H |
| 6 | 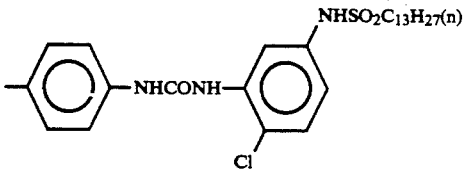 | $-CONHC_2H_5$ | Cl |
| 7 | 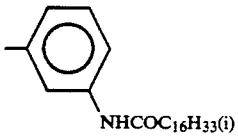 | 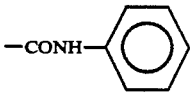 | H |
| 8 | 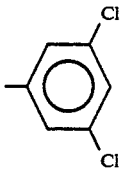 | 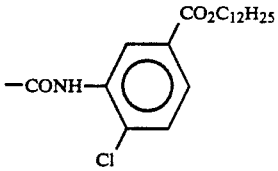 | 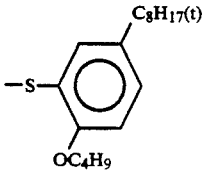 |
| 9 | 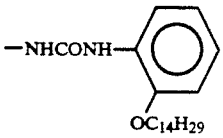 | CN | H |
| 10 | 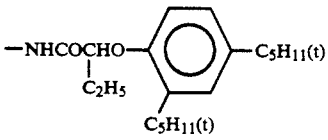 | 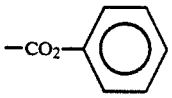 | H |
| 11 | 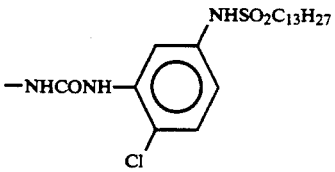 | 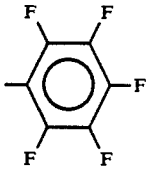 | H |
| 12 | 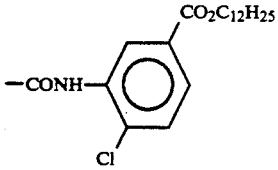 | CN | H |
| 13 | 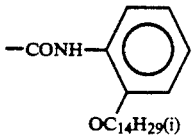 | CN | 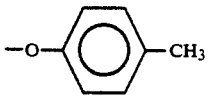 |

-continued
| No. | $R_1$ | $R_2$ | X |
|---|---|---|---|
| 14 | $-CONHC_{16}H_{33}(n)$ | CN | H |
| 15 | $-CONHC_{12}H_{25}(n)$ | CN | H |
| 16 | 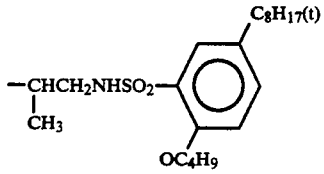 | $CF_3$ | Cl |
| 17 | 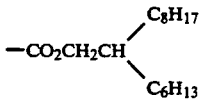 | $C_3F_7$ | 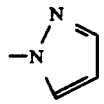 |
| 18 | 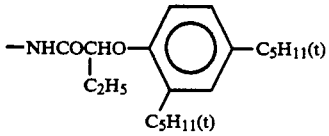 | 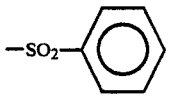 | $-OSO_2CH_3$ |
| 19 | 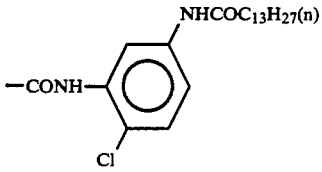 | $-SO_2CH_3$ | 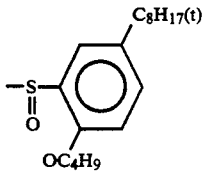 |
| 20 | 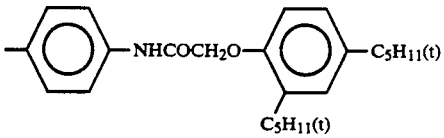 | CN | 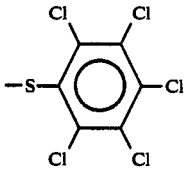 |
| 21 | 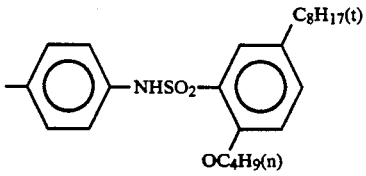 | CN | 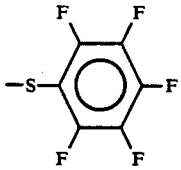 |
| 22 | 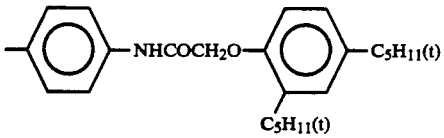 | CN | 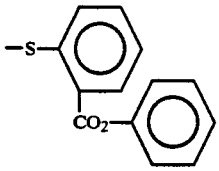 |
| 23 | 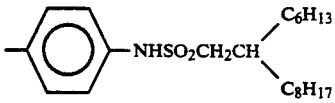 | 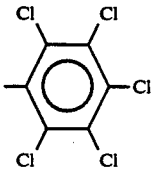 | 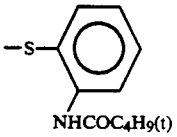 |

-continued

| No. | $R_1$ | $R_2$ | X |
|---|---|---|---|
| 24 | 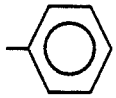 | $-CO_2C_{16}H_{33}(i)$ | 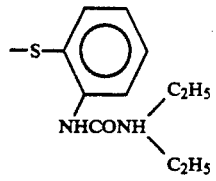 |
| 25 | 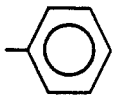 | $-CO_2C_{18}H_{37}(i)$ | H |
| 26 | 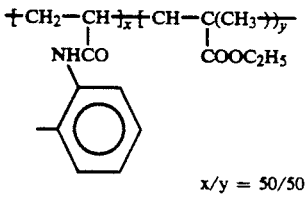 x/y = 50/50 | CN | H |
| 27 | $-NHSO_2C_{16}H_{33}(i)$ | $-CO_2CH_2(CF_2)_4H$ | 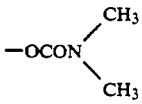 |
| 28 | 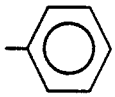 | $-CO_2CH_2CH_2C_6F_{13}$ | 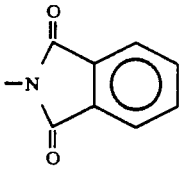 |
| 29 | 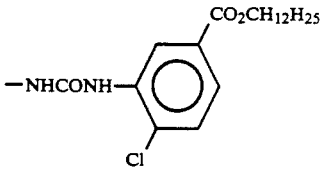 | 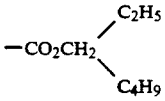 | Cl |
| 30 | 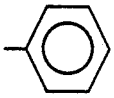 | 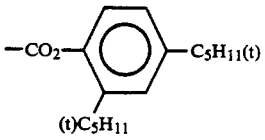 | Cl |
| 31 | 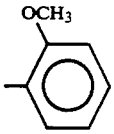 | $-CO_2C_{14}H_{29}(sec)$ | Cl |
| 32 | 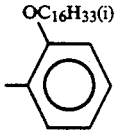 | $-CO_2C_4H_9(sec)$ | Cl |

Intermediates of compounds of the present invention can be produced by conventional known methods. For instance, the methods as described in *Research Disclosure* 16216 (1977), *Heterocyclic Compounds,* 13965 (1963), and *Chem. Ber.,* 101, 2117 (1968), the methods as described in the literature as referred to therein, as well as other methods analogous to the disclosed methods can be employed.

Some synthesis examples of producing couplers of formula (I) of the present invention are mentioned below.

SYNTHESIS EXAMPLE 1

Production of Compound (1)

Compound (1) was produced in accordance with the following reaction scheme.

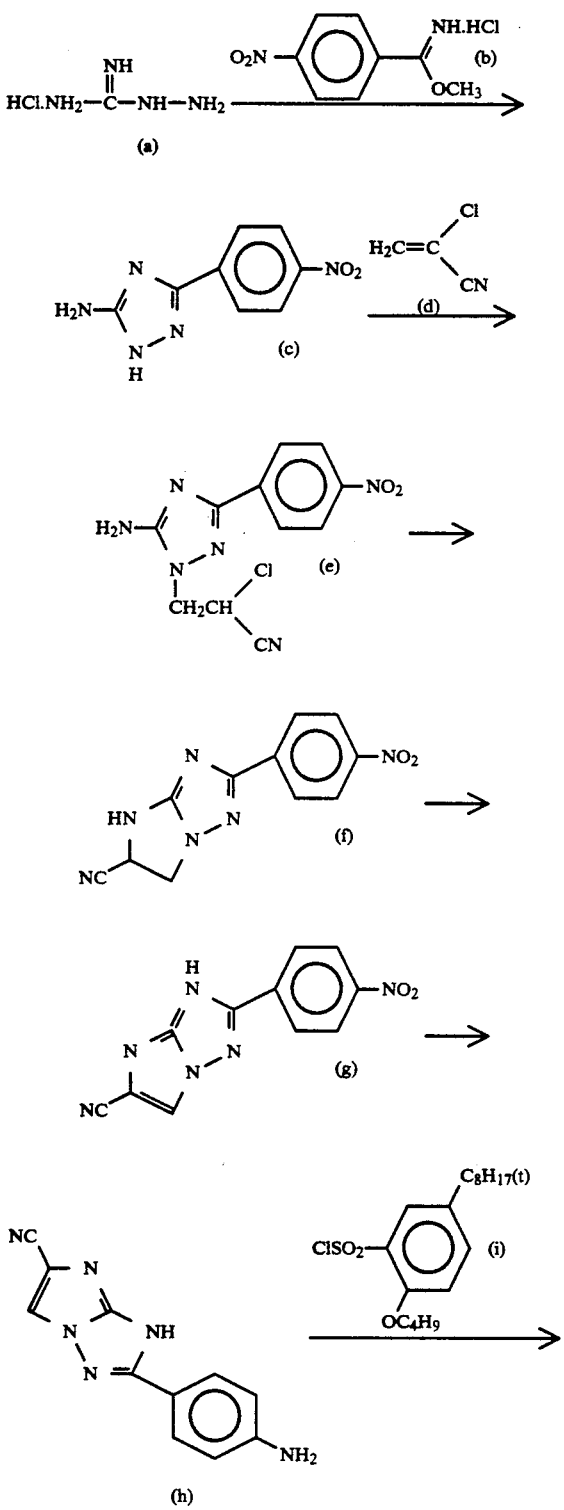

-continued

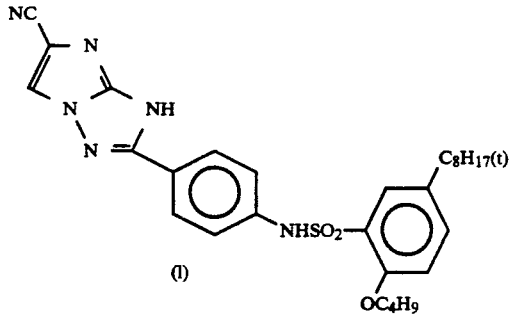

111 g of (a) and 241 g of (b) were dissolved in 1.5 liters of pyridine and heated under reflux for 2 hours. After pyridine was removed by distillation, 95 g of (c) was obtained by crystallization in water.

50.0 g of (c) thus obtained and 27.7 ml of (d) were dissolved in 500 ml of tetrahydrofuran, and 8.3 ml of N,N,N',N'-tetramethylguanidine was gradually added thereto with the reaction temperature being kept at 0° C. After reaction, ethyl acetate was added to the reaction mixture, which was then washed with water. The ethyl acetate layer thus separated was dried, and 56.1 g of (e) was obtained by distillation and crystallization from methanol. 56.1 g of (e) thus obtained was dissolved in 500 ml of tetrahydrofuran, and 44 ml of 28% sodium methylatemethanol solution was added thereto and heated at reflux for 2 hours. After reaction, ethyl acetate was added to the reaction mixture, which was then washed with water. The ethyl acetate layer thus separated was dried, ethyl acetate was removed by distillation therefrom, 400 ml of carbon tetrachloride was added to the residue, and 24.5 g of N-chlorosuccinimide was added thereto and heated at reflux for one hour. After the reaction, the reaction mixture was extracted with methylene chloride and dried, and the solvent was removed by distillation. The residue was crystallized from methanol to obtain 38.5 g of an intermediate (g).

85 g of reduced iron and 30 g of ammonium chloride were added to 400 ml of isopropyl alcohol and 100 ml of water and heated at reflux for 30 minutes. To this was gradually added 38.5 g of (g) and refluxed for 2 hours. After reaction, the reaction mixture was filtered with Celite, and the solvent of the filtrate was removed by distillation. The residue thus obtained was dissolved in 400 ml of demethyl acetamide (DMAC), and 63.4 g of (i) and 12 ml of pyridine were added thereto and stirred at room temperature (about 20°-30° C.) for 5 hours. After the reaction, ethyl acetate was added to the reaction mixture, which was then washed with water and dried. The solvent was removed by distillation, and the residue was purified by column chromatography to obtain 65.0 g of the Compound (1).

SYNTHESIS EXAMPLE 2

Production of Compound (21)

Compound (21) was produced in accordance with the following reaction scheme.

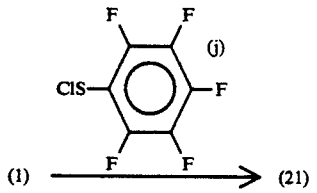

2.5 g of (1) was dissolved in 25 ml of dimethyl formamide (DMF), and 1.1 g of (j) dissolved in 5 ml of methylene chloride was gradually dropwise added thereto at room temperature. After the reaction, methylene chloride was added to the reaction mixture, which was then washed with water. The organic layer thus separated was dried, the solvent was removed by distillation, and the residue was purified by column chromatography to obtain 2.1 g of the intended Compound (21).

Other compounds described above can be produced in the same manner as above.

The photographic material of the present invention may be one which has at least one layer containing the cyan coupler(s) of the present invention on a support. The layer of containing the cyan coupler(s) used in the present invention may be a hydrophilic colloid layer on a support. A conventional photographic material has at least one blue-sensitive silver halide emulsion layer, at least one green-sensitive silver halide emulsion layer and at least one red sensitive silver halide emulsion layer on a support in this order, and the order of the layers on the support may be different from this order. The material may contain an infrared-sensitive silver halide emulsion layer in place of at least one of the above-described light-sensitive emulsion layers. These light-sensitive emulsion layers each may comprise a silver halide emulsion sensitive to the respective wavelength range and a color coupler forming a dye having a complementary color to light to which the emulsion is sensitive, whereby color reproduction by subtractive color photography can be achieved. The relationship between the light-sensitive emulsion layer and the color hue of the dye to be formed from the color coupler in the layer is not limited to the above-described constitution but may be any other constitution.

Where the cyan couplers of the present invention are applied to photographic materials, they are preferably incorporated in the red-sensitive silver halide emulsion layer of the material.

The content of the cyan coupler(s) of the present invention in the photographic material may be from $1\times10^{-3}$ mol to 1 mol, preferably from $2\times10^{-3}$ mol to $3\times10^{-1}$ mol, per mol of silver halide.

The cyan couplers of the present invention can be introduced into the photographic material using various known techniques. Preferred is an oil-in-water dispersion method in which the coupler is dissolved in a high boiling point organic solvent (if desired, along with a low boiling point organic solvent) and the resulting solution is dispersed in an aqueous gelatin solution by emulsification and added to a silver halide emulsion.

Examples of suitable high boiling point solvents which can be used in an oil-in-water dispersion method which may be employed in the present invention are described in U.S. Pat. No. 2,322,027. A latex dispersion method is one polymer dispersion method which may also be employed in the present invention. The process of such a latex dispersion method, the effect of the same and specific examples of latexes for impregnation which can be used in the method are described in U.S. Pat. No. 4,199,363, German Patent OLS Nos. 2,541,274 and 2,541,230, JP-B-53-41091 and European Patent 029 104 A. A dispersion method using organic solvent-soluble polymers may also be employed in the present invention, which is described in PCT International Publication W088/00723.

Examples of high boiling point organic solvents usable in the above-mentioned oil-in-water method include phthalates (e.g., dibutyl phthalate, dioctyl phthalate, dicyclohexyl phthalate, di-2-ethylhexyl phthalate, decyl phthalate, bis(2,4-di-t-amylphenyl) isophthalate, bis(1,1-diethylpropyl) phthalate), phosphates or phosphonates (e.g., diphenyl phosphate, triphenyl phosphate, tricresyl phosphate, 2-ethylhexyl-diphenyl phosphate, dioctylbutyl phosphate, tricyclohexyl phosphate, tri-2-ethylhexyl phosphate, tridodecyl phosphate, di-2-ethylhexylphenyl phosphate), benzoates (e.g., 2-ethylhexyl benzcate, 2,4-dichlorobenzoate, dodecyl benzoate, 2-ethylhexyl p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate, trioctyl citrate), aniline derivatives (e.g., N,N-dibutyl-2-butoxy-5-tert-octylaniline), chlorinated paraffins (e.g., paraffins having chlorine content of from 10% to 80%), trimesates (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, 4-(4-dodecyloxycarbonylphenol, carboxylic acids (e.g., 2-(2,4-di-tert-amylphenoxybutyric acid, 2-ethoxyoctanedecanoic acid), and alkylphosphoric acids (e.g., di-(2-ethylhexyl)phosphoric acid, diphenylphosphoric acid). Auxiliary solvents which can be used with high boiling point organic solvents are, for example, organic solvents having a boiling point of approximately from 30° C. to 160° C., such as ethyl acetate, butyl acetate, ethyl propionate, methyl ethyl ketone, cyclohexanone, 2-ethoxyethyl acetate, and dimethylformamide.

The proportion of high boiling point organic solvent used in this case may be from 0 to 10.0 times, preferably from 0 to 4.0 times, to the coupler.

The silver halide emulsions and other elements (e.g., additives, etc.) forming the photographic material of the present invention, photographic layers forming the material (e.g., arrangement of layers), and methods of processing the material and additives usable in the processing methods are described in the following patent publications, especially in European Patent 0 355 660 A2, and these can be advantageously employed.

| Photographic Element | JP-A 62-215272 | JP-A 2-33144 | EP 0 355 660 A2 |
|---|---|---|---|
| Silver Halide Emulsions | From page 10, right upper column, line 6 to page 12, left lower column, line 5; and from page 12, right lower column, line 4 to page 13, left | From page 28, right upper column, line 16 to page 29, right lower column, line 11; and page 30, lines 2 to 5 | From page 45, line 53 to page 47, line 3; and page 47, lines 20 to 22 |

-continued

| Photographic Element | JP-A 62-215272 | JP-A 2-33144 | EP 0 355 660 A2 |
|---|---|---|---|
| | upper column, line 17 | | |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left lower column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-Fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Lower Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right upper column, lines 8 to 11 | From page 64, line 57 to page 65, line 1 |
| Gradation Adjusting Agents | Page 188, right lower column, line 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to | — |

-continued

| Photographic Element | JP-A 62-215272 | JP-A 2-33144 | EP 0 355 660 A2 |
|---|---|---|---|
| | | right lower column, line 9 | |
| Fluorine-Containing Compounds (as antistatic agents, coating aids, lubricants, and anti-blocking agents) | From page 210, left lower column, line 1 to page 222, left lower column, line 5 | From page 25, left upper column, line 1 to page 27, right upper column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps and additives | From page 3, right upper column, line 7 to page 10, right upper column, line 5 | From page 39, left upper column, line 4 to page 42, left upper column, last line | From page 67, line 14 to page 69, line 28 |

The citation to JP-A-62-215272 includes the letter of amendment filed on March 15, 1987.

Of the above-mentioned color couplers, the so-called shortwave type yellow couplers as described in JP-A-63-231451, JP-A-63-123047, JP-A-63-241547, JP-A-1-173499, JP-A-1-213648 and JP-A-1-250944 are also preferably used as yellow couplers.

Silver halides which can be used in the photographic material of the present invention include silver chloride, silver bromide, silver chlorobromide, silver iodochlorobromide and silver iodobromide. For the purpose of rapidly processing the photographic material, a silver chlorobromide emulsion having a silver chloride content of 90 mol % or more, preferably 95% or more, especially preferably 98% or more, which does not substantially contain silver iodide or a pure silver chloride emulsion, is preferred.

For the purpose of improving the sharpness of the image to be formed in the photographic material of the present invention, it is preferred to incorporate a dye capable of being decolored by photographic processing, as described in European Patent 0 337 490 A2 (especially oxonole dyes), into the hydrophilic colloid layer of the material in such an amount that the optical reflection density of the material at 680 nm is 0.70 or more, or to incorporate titanium oxide surface-treated with a di-hydric to tetra-hydric alcohol (e.g., trimethylolethane) into the water-proof resin layer of the support of the material in an amount of 12% by weight, or more, more preferably 14% by weight or more.

The photographic material of the present invention preferably contains a color image preservability improving compound, for example, one as described in European Patent 0 277 589 A2, along with couplers. Incorporation of such a color image preservability improving compound into the material along with a pyrazoloazole magenta coupler is preferred.

Specifically, the single or combined incorporation of a compound (F) described in European Patent Application 0 277 589 A2 which chemically binds with aromatic amine developing agent remaining in the photographic material after color development thereof to form a chemically inactive and substantially colorless compound and/or a compound (G) described in European Paten Application 0 277 589 A2 which chemically binds with the oxidation product of an aromatic amine developing agent remaining in the photographic material after color development thereof to form a chemically inactive and substantially colorless compound into the photographic material of the present invention is preferred for the purpose of preventing formation of color dyes by reaction of the color developing agent or the oxidation product thereof remaining in the photographic material and couplers in the material during storage of the processed material to cause formation of stains in the processed material during storage thereof and also preventing any other harmful side effect of the agent remaining and oxidation product of thereof remaining.

The photographic material of the present invention also preferably contain a microbiocide, e.g., as described in JP-A-63-271247, for the purpose of preventing growth of various fungi and bacteria in the hydrophilic colloid layer of the processed material which would deteriorate the image formed on the material.

Suitable supports which can be used in the photographic material of the present invention include a white polyester support or a support having a white pigment-containing layer on the side facing the silver halide emulsion layers coated thereover may be employed for displays. In order to improve the sharpness of the image to be formed, it is preferred to use an antihalation layer on the support on either of the side to face with silver halide emulsion layers as coated thereover or the opposite back side thereto. In particular, it is preferred to define the transmission density of the support to fall within the range of from 0.35 to 0.8, in order that the display with the photographic material of the present invention be may seen either using reflected light or transmitted light.

The photographic material of the present invention may be exposed either with visible rays or with infrared rays. Either low illumination intensity exposure or high illumination intensity short-time exposure may be employed for exposure of the material. In particular, in the latter case, a laser scanning exposure system is preferred where the exposure time is shorter than $10^{-4}$ second per pixel.

In exposure of the photographic material of the present invention, a band stop filer described in U.S. Pat. No. 4,880,726 is preferably used. By using it, rays causing color mixture may be removed so that the color reproducibility of the exposed material is improved noticeably.

The present invention is explained in greater detail by reference to the following examples, which, however, are not intended to be construed as restricting the scope of the present invention. Again, all parts, percents, ratios and the like are by weight unless otherwise indicated.

EXAMPLE 1

Formation of Photographic Material Sample No. 101

Two layers each having the composition described below were coated on a cellulose triacetate film support to form a photographic material Sample No. 101. The coating liquid for the first layer was prepared in the manner described below.

Preparation of Coating Liquid for First Layer 1.01 g of cyan coupler (ExC) and 1.0 g of dibutyl phthalate were completely dissolved in 10.0 cc of ethyl acetate. The coupler solution in ethyl acetate was added to 42 g of an aqueous 10% gelatin solution (containing 5 g/liter of sodium dodecylbenzenesulfonate) and emulsified and dispersed with a homogenizer. After emulsification and dispersion, distilled water was added to the dispersion to make 100 g in total. 100 g of the emulsified dispersion and 8.2 g of a red-sensitive high-silver chloride emulsion (with a silver bromide content of 0.5 mol %, to which $1.0\times10^{-4}$ mol per mol of silver halide of the following red-sensitizing dye was added) were blended to prepare a coating liquid for the first layer having the composition described below.

1-Hydroxy-3,5-dichloro-s-triazine sodium salt was used as a gelatin hardening agent.

Cyan Coupler (ExC):

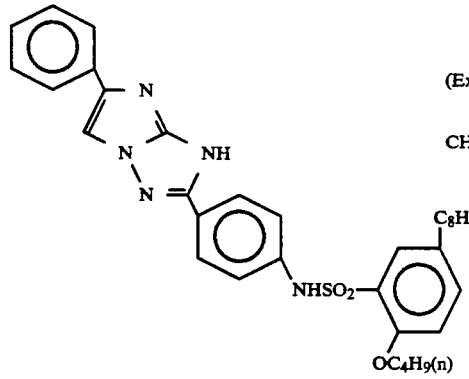

-continued

Sensitizing Dye E for Red-Sensitive Emulsion:

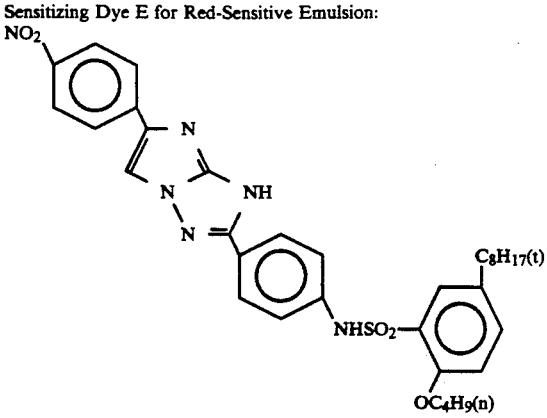

Layer Structure

The layer structure of the sample is shown below.

Support

Cellulose Triacetate Film

| | |
|---|---|
| First Layer: Emulsion Layer | |
| Red-Sensitive High-Silver Chloride Emulsion | 0.86 g/m$^2$ as Ag |
| Gelatin | 2.50 g/m$^2$ |
| Cyan Coupler (ExC) | 0.49 g/m$^2$ |
| Tricresyl Phosphate | 1.00 g/m$^2$ |
| Second Layer: Protective Layer | |
| Gelatin | 1.60 g/m$^2$ |

Formation of Photographic Material Samples Nos. 102 to 107

Samples Nos. 102 to 107 were formed in the same manner as in formation of Sample No. 101, except that cyan coupler (ExC) was replaced by the same molar amount of a coupler as indicated in Table A below. Cyan coupler (ExC-2) is as follows:

(ExC-2):

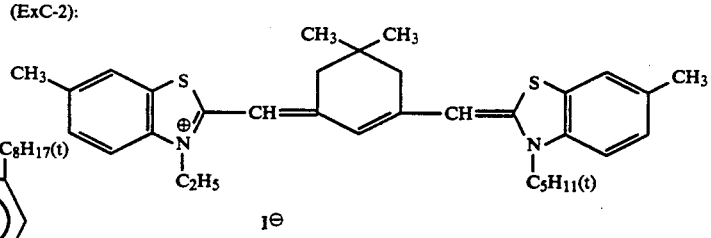

Samples Nos. 101 to 107 thus prepared were subjected to continuous wedgewise exposure using white light and then developed in accordance with the process described below.

The density of each of the thus processed samples was measured, whereupon the absorption spectrum in the high density area was measured. Table A below shows the λmax and half-value width values of each sample.

| Development Process: | | |
|---|---|---|
| Processing Step | Temperature | Time |
| Color Development | 38° C. | 45 sec |

-continued

| Development Process: | | |
|---|---|---|
| Processing Step | Temperature | Time |
| Bleach-Fixation | 35° C. | 45 sec |
| Rinsing (1) | 35° C. | 30 sec |
| Rinsing (2) | 35° C. | 30 sec |
| Rinsing (3) | 35° C. | 30 sec |
| Drying | 80° C. | 60 sec |

Rinsing was effected by a countercurrent system from rinsing tank (3) to rinsing tank (1).

The compositions of the processing solutions used above are described below.

| Color Developer: | |
|---|---|
| Water | 800 ml |
| Ethylenediamine-N,N,N,N-tetramethylenephosphonic Acid | 3.0 g |
| Triethanolamine | 8.0 g |
| Potassium Chloride | 3.1 g |
| Potassium Bromide | 0.015 g |
| Potassium Carbonate | 25 g |
| Hydrazinodiacetic Acid | 5.0 g |
| N-ethyl-N-(β-methanesulfonamidoethyl)-3-methyl-4-aminoaniline Sulfate | 5.0 g |
| Brightening Agent (WHITEX-4, produced by Sumitomo Chemical Co.) | 2.0 g |
| Water to make | 1000 ml |
| pH (with potassium hydroxide) | 10.05 |
| Bleach-Fixing Solution: | |
| Water | 400 ml |
| Ammonium Thiosulfate Solution (700 g/liter) | 100 ml |
| Ammonium Sulfite | 45 g |
| Ammonium Ethylenediaminetetraacetate/Fe(III) | 55 g |
| Ethylenediaminetetraacetic Acid | 3 g |
| Ammonium Bromide | 30 g |
| Nitric Acid (67% aq. soln.) | 27 g |
| Water to make | 1000 ml |
| pH | 5.8 |

Rinsing Solution

Ion-exchanged Water (having a calcium content and magnesium content each of 3 ppm or less).

TABLE A

| Sample No. | Coupler | λmax (nm) | Half-Value Width (nm) | Remarks |
|---|---|---|---|---|
| 101 | ExC | 576 | 92 | Comparative sample |
| 102 | ExC-2 | 610 | 103 | Comparative sample |
| 103 | (1) | 633 | 85 | Sample of the invention |
| 104 | (4) | 625 | 88 | Sample of the invention |
| 105 | (9) | 634 | 83 | Sample of the invention |
| 106 | (21) | 630 | 85 | Sample of the invention |
| 107 | (25) | 621 | 88 | Sample of the invention |

The couplers in Samples Nos. 101 and 102 are modified from the couplers (190) and (191) as disclosed in U.S. Pat. No. 4,910,127 and the preceding literature *Research Disclosure* by inserting a ballast group thereinto in order that the modified couplers may be incorporated into a photographic material. It is noted from the results in Table A above that the coupler in Sample No. 101 in which the position corresponding to $R_2$ of formula (I) is substituted by an unsubstituted phenyl group (having a σp value of about 0.0) gave a dye having a longer wavelength than the coupler in Sample No. 102 in which the same position corresponding to $R_2$ of formula (I) is substituted by a p-nitro-phenyl group (having a σp value of about 0.2). However, contrary to the longer wavelength, it is also noted from Table A that the dye from the coupler in Sample No. 101 had a broader half-value width than that from the coupler in Sample No. 102. That is, the former dye had a broader wavelength range than the latter dye. The fact is supported by the prior description of the coupler in *Research Disclosure*. In contrast, the couplers used in the present invention provided dyes having a relatively long wavelength without broadening the wavelength range. In addition, surprisingly, the couplers used in the present invention produced dyes having a sharper spectrum than any other conventional couplers, but not only broadening the wavelength range spectrum.

EXAMPLE 2

A paper support, both surfaces of which had been laminated with polyethylene, was subjected to corona discharging treatment, and a gelatin subbing layer containing sodium dodecylbenzenesulfonate was provided thereon. Next, plural photographic layers each having the composition described below were coated thereover to form a multi-layer color photographic material (Sample No. 201). Coating liquids were prepared in the manner described below.

Preparation of Coating Liquid for First Layer 153.0 g of yellow coupler (ExY), 15.0 g of color image stabilizer (Cpd-1), 7.5 g of color image stabilizer (Cpd-2) and 16.0 g of color image stabilizer (Cpd-3) were dissolved in 25 g of solvent (Solv-1), 25 g of solvent (Solv-2) and 180 cc of ethyl acetate. The resulting solution was dispersed by emulsification in 1000 g of an aqueous 10% gelatin solution containing 60 cc of 10% sodium dodecylbenzenesulfonate and 10 g of citric acid to obtain Emulsified Dispersion A. On the other hand, a silver chlorobromide Emulsion A (3/7 (by mol of silver) mixture of large-size emulsion A of cubic grains with a mean grain size of 0.88 μm and small-size emulsion A of cubic grains with a mean grain size of 0.70 μm; the variation coefficient of the grain size distribution of the two emulsions was 0.08 and 0.10, respectively; both emulsions had 0.3 mol % of silver bromide locally on a part of the grain surface) was prepared. The emulsion contained the following blue-sensitizing dyes A and B each in an amount of $2.0\times10^{-4}$ mol per mol of silver in the large-size emulsion A and $2.5\times10^{-4}$ mol per mol of silver in the small-size emulsion A. Chemical ripening of the emulsion was effected using sulfur sensitization and gold sensitization. Emulsified Dispersion A as previously prepared and the silver chlorobromide Emulsion A were blended to give a coating liquid for the first layer having the composition described below.

Preparation of Coating Liquid for Fifth Layer 60.0 cc of ethyl acetate was added to 33.0 g of cyan coupler (ExC'), 18.0 g of ultraviolet absorbent (UV-2) 30.0 g of color image stabilizer (Cpd-1), 15.0 g of color image stabilizer (Cpd-9), 15.0 g of color image stabilizer (Cpd-10), 1.0 g of color image stabilizer (Cpd-11), 1.0 g of color image stabilizer (Cpd-8), 1.0 g of color image stabilizer (Cpd-6), 22.0 g of solvent (Solv-6) and 1.0 g of solvent (Solv-1) and dissolved. The resulting solution was added to 500 cc of an aqueous 20% gelatin solution containing 8 cc of sodium dodecylbenzenesulfonate and then emulsified and dispersed with an ultrasonic homogenizer to prepare an Emulsified Dispersion C. On the other hand, a silver chlorobromide Emulsion C (1/4 (by mol of silver) mixture of large-size emulsion C of cubic grains with a mean grain size of 0.50 μm and small-size emulsion C of cubic grains with a mean grain size of 0.41 μm; the variation coefficient of the grain size distribution of the two emulsions was 0.09 and 0.11, respectively; both emulsions had 0.8 mol % of silver bromide locally on a part of the grain surface) was prepared. The emulsion contained the following red-sensitizing dye E in an amount of $0.9\times10^{-4}$ mol per mol of silver in the large-size emulsion C and $1.1\times10^{-4}$ mol per mol of silver in the small-size emulsion C. Further, it contained compound F in an amount of $2.6\times10^{-3}$ mol per mol of silver halide. Chemical ripening of the emulsion C was effected using sulfur sensitization and gold sensitization. The emulsified dispersion C as previously prepared and the red-sensitive silver chlorobromide Emulsion C were blended to give a coating liquid for the Fifth Layer having the composition described below.

The other coating liquids for the Second Layer, Third Layer, Fourth Layer, Sixth Layer and Seventh Layer were also prepared in the same manner as in preparation of the coating liquid for the First Layer. As a gelatin hardening agent for each layer, 1-hydroxy-3,5-dichloro-s-triazine sodium salt was added thereto.

The respective layers contained 25.0 mg/m², in total, of Cpd-14 and 50 mg/m², in total, of Cpd-15.

Color sensitizing dyes added to the silver chlorobromide emulsions of the respective light-sensitive emulsion layers are shown below.

Blue-sensitive Emulsion Layer:
Sensitizing Dye A:

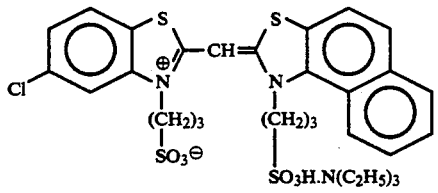

Sensitizing Dye B:

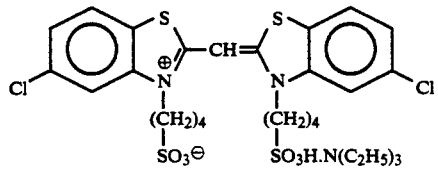

Green-sensitive Emulsion Layer:
Sensitizing Dye C:

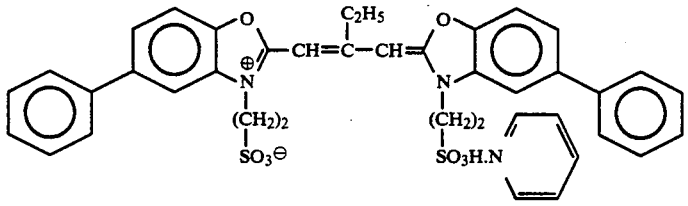

($4.0\times10^{-4}$ mol per mol of silver halide to large-size emulsion B; and $5.6\times10^{-4}$ mol per mol of silver halide to small-size emulsion B)

Sensitizing Dye D:

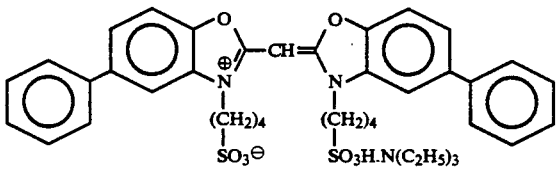

($7.0\times10^{-5}$ mol per mol of silver halide to large-size emulsion B; and $1.0\times10^{-5}$ mol per mol of silver halide to small-size emulsion B)

Red-sensitive Emulsion Layer:
Sensitizing Dye E:

-continued

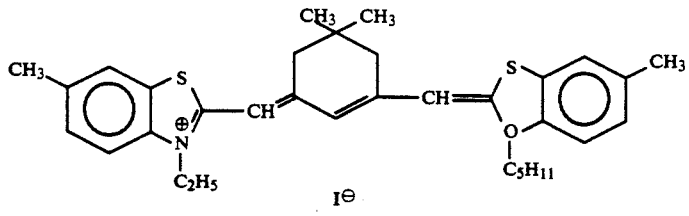

Compound F:

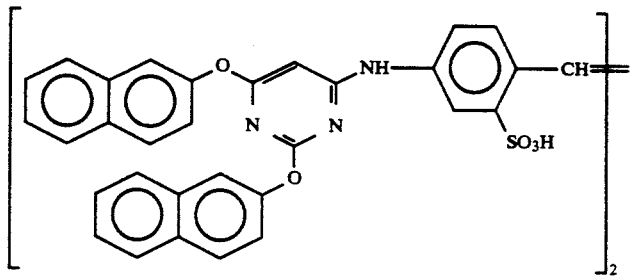

1-(5-Methylureidophenyl)-5-mercaptotetrazole each in an amount of $8.5\times10^{-5}$ mol, $7.7\times10^{-4}$ mol and $2.5\times10^{-4}$ mol, per mol of silver halide, respectively was added to the blue-sensitive emulsion layer, green-sensitive emulsion layer and red-sensitive emulsion layer.

4-Hydroxy-6-methyl-1,3,3a,7-tetrazaindene each in an amount of $1\times10^{-4}$ mol and $2\times10^{-4}$ mol, per mol of silver halide, respectively was added to the blue-sensitive emulsion layer and green-sensitive emulsion layer.

The following dyes were added to the respective emulsion layers, the coated amount being in parentheses for anti-irradiation.

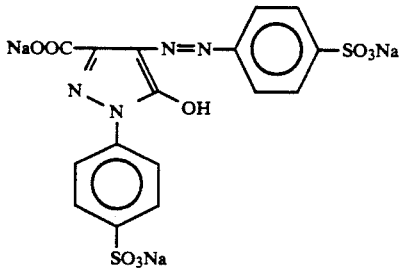

(10 mg/m²)

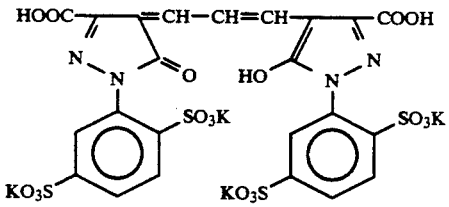

(10 mg/m²)

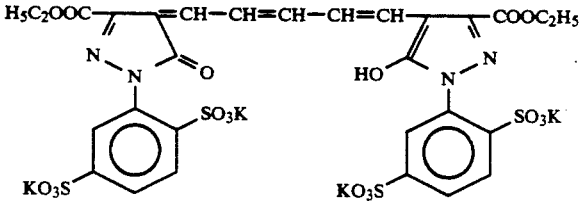

(40 mg/m²)

-continued

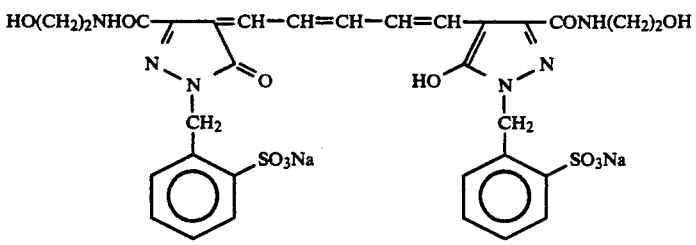

(20 mg/m²)

Layer Structure

The compositions of the layers forming Sample No. 201 are described below, in which the numerical value indicates the amount coated (g/m²) and the amount of the silver halide coated is represented as silver therein.

Support

Polyethylene-laminated Paper (containing white pigment ($TiO_2$) and bluish dye (ultramarine) in polyethylene below the first layer)

| | |
|---|---|
| First Layer: Blue-sensitive Emulsion Layer | |
| Silver Chlorobromide Emulsion A | 0.27 |
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| Second Layer: Color Mixing Preventing Layer | |
| Gelatin | 1.00 |
| Color Mixing Preventing Agent (Cpd-4) | 0.06 |
| Solvent (Solv-7) | 0.03 |
| Solvent (Solv-2) | 0.25 |
| Solvent (Solv-3) | 0.25 |

Third Layer: Green-sensitive Emulsion Layer

Silver Chlorobromide Emulsion (⅓ mixture (by mol of Ag) of large-size emulsion B of cubic grains with a mean grain size of 0.55 μm and small-size emulsion B of cubic grains with a mean grain size of 0.39 μm; the two emulsions each had a variation coefficient of the grain size distribution of 0.10 and 0.08, respectively; they contained 0.8 mol % of AgBr locally on a part of the grain surface)

| | |
|---|---|
| | 0.13 |
| Gelatin | 1.45 |
| Magenta Coupler (ExM) | 0.16 |
| Color Image Stabilizer (Cpd-5) | 0.15 |
| Color Image Stabilizer (Cpd-2) | 0.03 |
| Color Image Stabilizer (Cpd-6) | 0.01 |
| Color Image Stabilizer (Cpd-7) | 0.01 |
| Color Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer: Color Mixing Preventing Layer | |
| Gelatin | 0.70 |
| Color Mixing Preventing Agent (Cpd 4) | 0.04 |
| Solvent (Solv 7) | 0.02 |
| Solvent (Solv-2) | 0.18 |
| Solvent (Solv-3) | 0.18 |
| Fifth Layer: Red-sensitive Emulsion Layer | |
| Silver Chlorobromide Emulsion C | 0.20 |
| Gelatin | 0.85 |
| Cyan Coupler (ExC') | 0.33 |
| Ultraviolet Absorbent (UV-2) | 0.18 |
| Color Image Stabilizer (Cpd-1) | 0.30 |
| Color Image Stabilizer (Cpd-9) | 0.15 |
| Color Image Stabilizer (Cpd-10) | 0.15 |
| Color Image Stabilizer (Cpd-11) | 0.01 |
| Solvent (Solv-6) | 0.20 |
| Color Image Stabilizer (Cpd-8) | 0.01 |
| Color Image Stabilizer (Cpd-6) | 0.01 |
| Solvent (Solv-1) | 0.01 |
| Sixth Layer: Ultraviolet Absorbing Layer | |
| Gelatin | 0.55 |
| Ultraviolet Absorbent (UV-1) | 0.38 |
| Color Image Stabilizer (Cpd-12) | 0.15 |
| Color Image Stabilizer (Cpd-5) | 0.02 |
| Seventh Layer: Protective Layer | |
| Gelatin | 1.13 |
| Acryl-modified Copolymer of Polyvinyl Alcohol (modification degree 17%) | 0.05 |
| Liquid Paraffin | 0.02 |
| Color Image Stabilizer (Cpd-5) | 0.01 |

The compounds used in the above layers are described below.

(ExY) Yellow Coupler:

1/1 (by mol) mixture of:

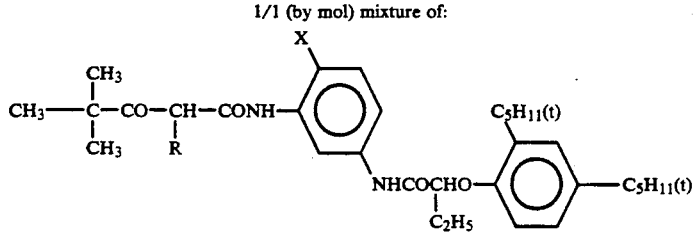

-continued
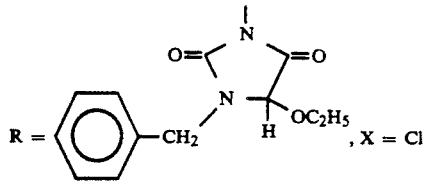
and
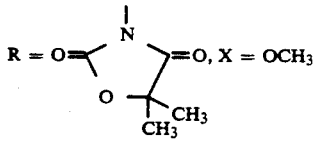
(ExM) Magenta Coupler:
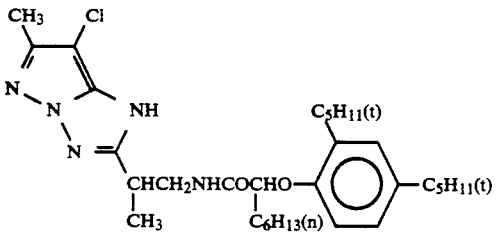
(ExC') Cyan Coupler:
3/7 (by mol) mixture of:
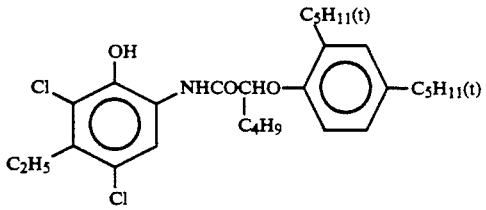
and
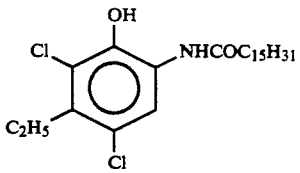
(Cpd-1) Color Image Stabilizer:
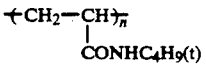
(average molecular weight: 60,000)
(Cpd-2) Color Image Stabilizer:
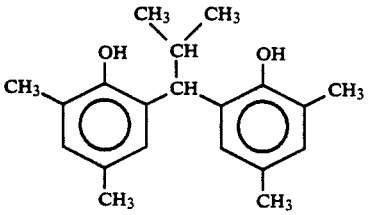
(Cpd-3) Color Image Stabilizer:

-continued
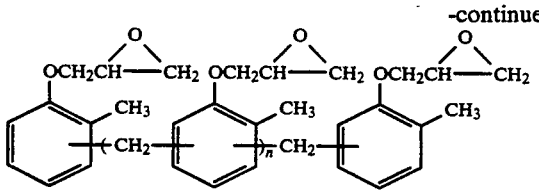
n = 7 to 8 (mean value)
(Cpd-4) Color Mixing Preventing Agent:
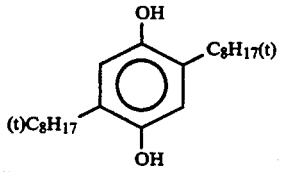
(Cpd-5) Color Image Stabilizer:
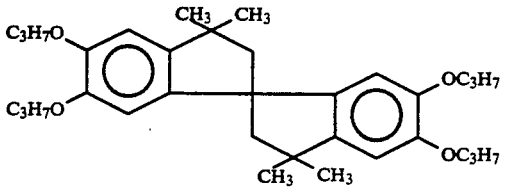
(Cpd-6):
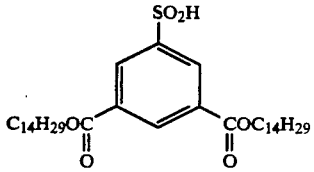
(Cpd-7):
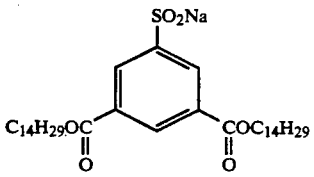
(Cpd-8) Color Image Stabilizer:
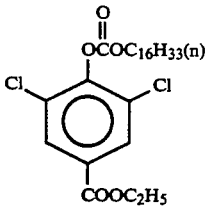
(Cpd-9) Color Image Stabilizer:
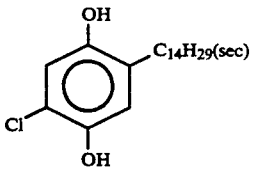
(Cpd-10) Color Image Stabilizer:
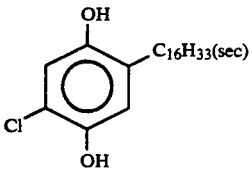
(Cpd-11):

-continued
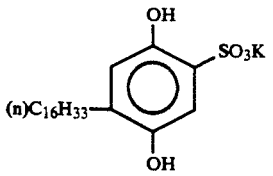
(Cpd-12):
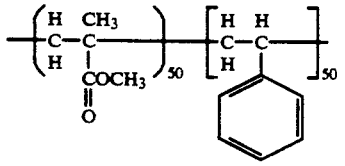
(average molecular weight: 60,000)
(Cpd-13):
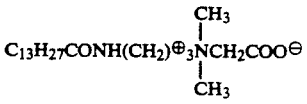
(Cpd-14) Antiseptic:
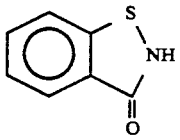
(Cpd-15) Antiseptic:
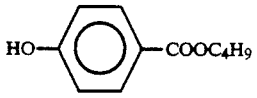
(UV-1) Ultraviolet Absorbent:
10/5/1/5 (by weight) mixture of:
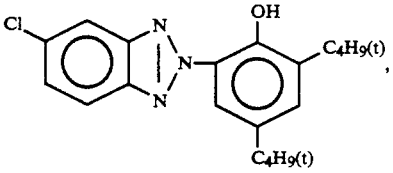
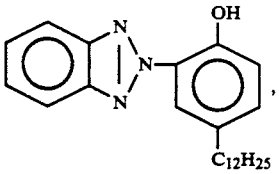
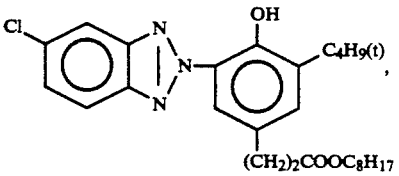
and
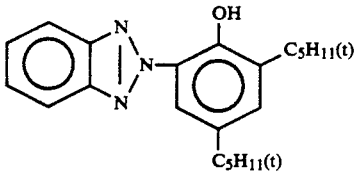

-continued
(UV-2) Ultraviolet Absorbent:
1/2/2 (by weight) mixture of:
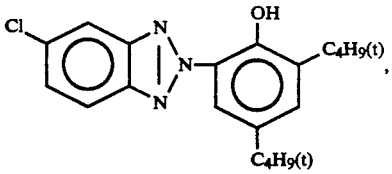
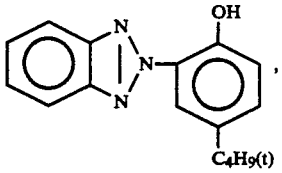
and
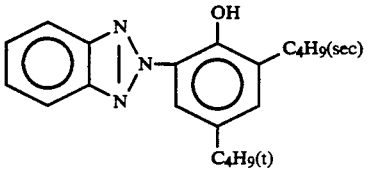
(Solv-1) Solvent:
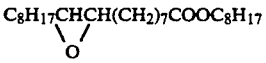
(Solv-2) Solvent:
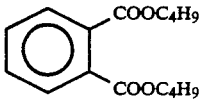
(Solv-3) Solvent:
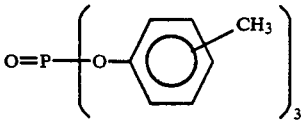
(Solv-4) Solvent:
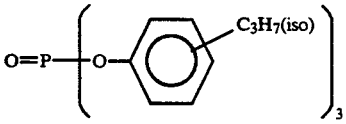
(Solv-5) Solvent:
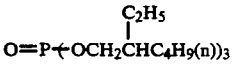
(Solv-6) Solvent:
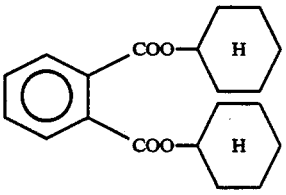
(Solv-7) Solvent:

-continued

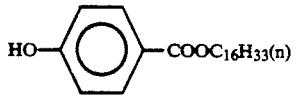

Photographic material samples Nos. 202 to 207 were prepared in the same manner as Sample No. 201, except that the cyan coupler (ExC') in Sample No. 201 was replaced by the same molar amount of ExC in Example 1 and Coupler (1), (4), (9), (21) and (25), respectively, used in the present invention.

These Samples Nos. 201 to 207 each were subjected to gray exposure in order that about 30% of the coated silver amount was developed, using a sensitometer (FWH Model, manufactured by Fuji Photo Film Co., Ltd.; with a light source color temperature of 3200° K.).

The exposed samples were processed by continuous processing with a paper processing machine, in accordance with the process described below using the processing solutions also described below, whereupon a developed condition of a running equilibrated condition was created.

Process:

| Processing Step | Temperature | Time | Amount of Replenisher (*) | Tank Capacity |
|---|---|---|---|---|
| Color Development | 35° C. | 45 sec | 161 ml | 17 liters |
| Bleach Fixation | 30 to 35° C. | 45 sec | 215 ml | 17 liters |
| Rinsing | 30° C. | 90 sec | 350 ml | 10 liters |
| Drying | 70 to 80° C. | 60 sec | | |

(*) per $m^2$ of sample being processed.

The compositions of the processing solutions used above are described below.

| Color Developer | Tank Solution | Replenisher |
|---|---|---|
| Water | 800 ml | 800 ml |
| Ethylenediamine-N,N,N',N'-tetramethylenephosphonic Acid | 1.5 g | 2.0 g |
| Potassium Bromide | 0.015 g | |
| Triethanolamine | 8.0 g | 12.0 g |
| Sodium Chloride | 1.4 g | |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-bis(Carboxymethyl)hydrazine | 4.0 g | 5.0 g |
| N,N-Di(sulfoethyl)hydroxylamine Monosodium Salt | 4.0 g | 5.0 g |
| Brightening Agent (WHITEX 4B, produced by Sumitomo Chemical Co.) | 1.0 g | 2.0 g |
| Water to make | 1000 ml | 1000 ml |
| pH (25° C.) | 10.05 | 10.45 |

| Bleach-Fixing Solution (tank solution and replenisher were the same) | |
|---|---|
| Water | 400 ml |
| Ammonium Thiosulfate (700 g/liter) | 100 ml |
| Sodium Sulfite | 17 g |
| Ammonium Ethylenediaminetetraacetato/Iron(III) | 55 g |
| Disodium Ethylenediaminetetraacetate | 5 g |
| Ammonium Bromide | 40 g |
| Water to make | 1000 ml |
| pH (25° C.) | 6.0 |

Rinsing Solution (tank solution and replenisher were the same):

Ion-exchanged Water (having a calcium and magnesium content each of 3 ppm or less).

Processed Samples Nos. 203 to 207 were shown to have a much smaller side absorption at 400 nm than processed Sample No. 201 and to have a better color reproducibility than processed Sample No. 202.

The cyan reflection density of each of the processed samples was measured with a Fuji System Densitometer (F.S.D.). After processing, the samples were stored under conditions of 65° C. and 35% RH for two months, and the cyan reflection density of each of them was again measured. The variation in the density of each of the stored samples from the density at 1.5 of each of the corresponding fresh samples was obtained.

The results confirmed that all the processed Samples Nos. 203 to 207 in accordance with the present invention yielded satisfactory dyes with high coloring property and they were free from a reduction in colored density even after storage.

As described above in detail, the photographic material of the present invention containing one or more cyan couplers of formula (I) provides a fast color image having an excellent absorption characteristic.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one red-sensitive silver halide emulsion layer containing at least one imidazotriazole cyan coupler of the following formula (I):

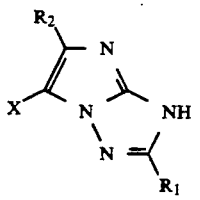

(I)

where $R_1$ represents a hydrogen atom or a substituent; $R_2$ represents an electron attracting group having a Hammett's constant value σp of 0.35 or more; X represents a hydrogen atom or a group released by coupling with an oxidation product of an aromatic primary amine color developing agent; and $R_1$ or $R_2$ may also be a divalent group forming a dimer or higher polymer, or they each may be bonded to a polymer chain to form a homopolymer or copolymer.

2. The silver halide color photographic material as in claim 1, wherein said electron attracting group having a Hammett's constant value σp of 0.35 or more represented by $R_2$ is selected from the group consisting of a cyano group, a nitro group, a carboxyl group, a fluorine-substituted alkyl group, an aliphatic, aromatic or heterocyclic acyl group, a formyl group, an aliphatic, aromatic or heterocyclic sulfonyl group, an aliphatic, aromatic or heterocyclic sulfinyl group, a carbamoyl group, an aliphatic, aromatic or heterocyclic oxy-carbonyl group, a heterocyclic group, an azo group, an alkylsulfonyloxy group a phosphoryl group, a sulfamoyl group, a pentachlorophenyl group, a pentafluorophenyl group, and a sulfonyl-substituted aromatic group.

3. The silver halide color photographic material as in claim 1, wherein said electron attracting group having a Hammett's constant value $\sigma p$ of 0.35 or more represented by $R_2$ is selected from the group consisting of a cyano group, an aliphatic or aromatic oxycarbonyl group, an aliphatic or aromatic sulfonyl group, an aliphatic or aromatic acyl group, a carbamoyl group, a pentafluorophenyl group, a pentachlorophenyl group, a perfluoroalkyl group, and a sulfamoyl group.

4. The silver halide color photographic material as in claim 1, wherein said electron attracting group having a Hammett's constant value $\sigma p$ of 0.35 or more represented by $R_2$ is a cyano group, an alkoxycarbonyl group, or an aryloxycarbonyl group.

5. The silver halide color photographic material as in claim 1, wherein $R_1$ is selected from the group consisting of a hydrogen atom, a halogen atom, an aliphatic group, an aromatic group, a heterocyclic group, an alkoxy group, an aryloxy group, an aliphatic, aromatic or heterocyclic acyloxy group, a carbamoyloxy group, an aliphatic, aromatic or heterocyclic sulfonyloxy group, an aliphatic, aromatic or heterocyclic acylamino group, an anilino group, a ureido group, a sulfamoylamino group, an alkenyloxy group, an alkylamino group, an aliphatic, aromatic or heterocyclic acyl group, an aliphatic, aromatic or heterocyclic sulfonyl group, an aliphatic, aromatic or heterocyclic oxycarbonyl group, an aliphatic, aromatic or heterocyclic oxycarbonylamino group, an aliphatic, aromatic or heterocyclic sulfonamido group, a carbamoyl group, a sulfamoyl group, a phosphoryl group, a sulfamido group, an imido group, a hydroxyl group, a carboxyl group, a nitro group, and a sulfo group.

6. The silver halide color photographic material as in claim 1, wherein $R_1$ is selected from the group consisting of an alkyl group, an aryl group, an alkoxy group, an aryloxy group, an acylamino group, a sulfonamido group, an alkylamino group, an anilino group, a ureido group, a sulfamoylamino group, an alkoxycarbonylamino group, an aryloxycarbonylamino group, a carbamoyl group, a sulfamoyl group, a sulfonyl group, an alkoxycarbonyl group, an aryloxycarbonyl group, an acyloxy group, and a carbamoyloxy group.

7. The silver halide color photographic material as in claim 1, wherein $R_1$ is selected from -the group consisting of an alkyl group, an aryl group, an acylamino group, a sulfonamido group, a ureido group, a sulfamoylamino group, a carbamoyl group, and a sulfamoyl group.

8. The silver halide color photographic material as in claim 1, wherein X is selected from the group consisting of a hydrogen atom, a halogen atom, an alkoxy group, an aryloxy group, an aliphatic, aromatic or heterocyclic acyloxy group, an aliphatic or aromatic sulfonyloxy group, an aliphatic, aromatic or heterocyclic acylamino group, an aliphatic or aromatic sulfonamido group, an alkoxycarbonyloxy group, an aryloxycarbonyloxy group, an aliphatic, aromatic or heterocyclic thio group, a carbamoylamino group, a 5-membered or 6-membered nitrogen-containing heterocyclic group, an imido group, and an aromatic azo group.

9. The silver halide color photographic material as in claim 1, wherein X is selected from the group consisting of a hydrogen atom, a halogen atom, and an aromatic thio group.

10. The silver halide color photographic material as in claim 1, wherein said photographic material contains from $1\times10^{-3}$ mol to 1 mol of at least one imidazotriazole cyan coupler of formula (I) per mol of silver halide.

* * * * *